US009568288B2

(12) United States Patent
Carpenter

(10) Patent No.: US 9,568,288 B2
(45) Date of Patent: Feb. 14, 2017

(54) SURFACE MOUNT EXPLODING FOIL INITIATOR

(71) Applicant: BATTELLE MEMORIAL INSTITUTE, Columbus, OH (US)

(72) Inventor: Jeffrey P. Carpenter, Lancaster, OH (US)

(73) Assignee: BATTELLE MEMORIAL INSTITUTE, Columbus, OH (US)

( * ) Notice: Subject to any disclaimer, the term of this patent is extended or adjusted under 35 U.S.C. 154(b) by 185 days.

(21) Appl. No.: 14/612,374

(22) Filed: Feb. 3, 2015

(65) Prior Publication Data

US 2015/0219428 A1 Aug. 6, 2015

Related U.S. Application Data

(60) Provisional application No. 61/935,996, filed on Feb. 5, 2014.

(51) Int. Cl.
*F42B 3/12* (2006.01)
*F42B 3/195* (2006.01)

(52) U.S. Cl.
CPC ..... *F42B 3/124* (2013.01); *F42B 3/195* (2013.01)

(58) Field of Classification Search
CPC ..... F42B 3/10; F42B 3/11; F42B 3/12; F42B 3/13; F42B 3/121; F42B 3/124; F42B 3/195
USPC ..... 102/202.7, 202.8
See application file for complete search history.

(56) References Cited

U.S. PATENT DOCUMENTS 5,230,287 A * 7/1993 Arrell, Jr. ..... F42B 3/195 102/202.5
5,285,727 A * 2/1994 Reams, Jr. ..... F42B 3/188 102/202.5
5,370,053 A * 12/1994 Williams ..... F42C 19/12 102/202.14
5,479,860 A * 1/1996 Ellis ..... E21B 43/1185 102/202.7
5,729,897 A * 3/1998 Schmidt ..... H05K 3/0041 174/262
5,743,004 A * 4/1998 Chobot ..... H05K 1/0201 228/180.1
5,969,286 A * 10/1999 Ward ..... F42B 3/124 102/202.14
6,054,760 A * 4/2000 Martinez-Tovar ..... F42B 3/13 257/692

(Continued)

FOREIGN PATENT DOCUMENTS

GB 2265209 A 9/1993

*Primary Examiner* — Troy Chambers
*Assistant Examiner* — Bridget Cochran
(74) *Attorney, Agent, or Firm* — Thomas E. Lees, LLC

(57) ABSTRACT

An exploding foil initiator system comprises a substrate having a first side and a second side, an exploding foil initiator and surface mount pads. The exploding foil initiator is formed on the first side of the substrate and comprises a first contact, a second contact and a channel that electrically connects the first contact and the second contact. A first surface mount pad is formed on the second side of the substrate. As second surface mount pad is also formed on the second side of the substrate. A first via extends through the substrate to electrically connect the first contact with the first surface mount pad. Analogously, a second via extends through the substrate to electrically connect the second contact to the second surface mount pad.

17 Claims, 4 Drawing Sheets

(56) References Cited

U.S. PATENT DOCUMENTS 6,158,347 A * 12/2000 Neyer ..... F42B 3/124 102/202.14
6,173,650 B1 1/2001 Garvick et al.
6,752,083 B1 * 6/2004 Lerche ..... E21B 43/1185 102/202.5
6,772,692 B2 * 8/2004 Baginski ..... F42B 3/198 102/202.7
7,581,496 B2 * 9/2009 Hennings ..... F42B 3/124 102/202.5
7,690,303 B2 * 4/2010 Reynolds ..... F42B 3/121 102/202.14
7,938,065 B2 5/2011 Desai
8,100,043 B1 * 1/2012 Nance ..... F42B 3/103 102/202.12
8,281,718 B2 * 10/2012 Rice ..... F42B 3/18 102/202.7
8,312,811 B2 * 11/2012 Christiansson ..... F42C 19/12 102/200
8,468,944 B2 * 6/2013 Givens ..... F42B 3/121 102/202.5
8,511,229 B2 * 8/2013 Desai ..... F42B 3/13 102/200
8,661,978 B2 * 3/2014 Backhus ..... F42B 3/121 102/200
2003/0192445 A1 * 10/2003 Baginski ..... F42B 3/198 102/202.5
2007/0056459 A1 * 3/2007 Martinez-Tovar ..... F42B 3/13 102/202.7
2007/0099335 A1 * 5/2007 Gangopadhyay ..... F42B 3/13 438/99
2008/0202325 A1 8/2008 Bertoja et al.
2009/0151584 A1 * 6/2009 Desai ..... F42B 3/121 102/202.7
2012/0227608 A1 * 9/2012 Givens ..... F42B 3/121 102/311
2013/0125772 A1 * 5/2013 Backhus ..... F42B 3/121 102/206
2014/0123866 A1 * 5/2014 Givens ..... F42B 3/121 102/312
2015/0260496 A1 * 9/2015 Backhus ..... F42B 3/121 102/311

* cited by examiner

SURFACE MOUNT EXPLODING FOIL INITIATOR

CROSS REFERENCE TO RELATED APPLICATIONS

This application claims the benefit of U.S. Provisional Patent Application Ser. No. 61/935,996, filed Feb. 5, 2014, entitled SURFACE MOUNT EXPLODING FOIL INITIATOR, the disclosure of which is hereby incorporated by reference.

BACKGROUND

The present invention relates in general to initiators for setting off detonation events, and in particular, to surface mount exploding foil initiators.

In various industries, such as mining, construction and other earth moving operations, it is common practice to utilize detonators to initiate explosives loaded into drilled blastholes for the purpose of breaking rock. In this regard, commercial electric and electronic detonators are conventionally implemented using hot wire igniters that include a fuse head as the initiating mechanism to initiate a corresponding explosive. Such hot wire igniters operate by delivering a low voltage electrical pulse, e.g., typically less than 20 volts (V), to the fuse head, causing the fuse head to heat up. Heat from the fuse head, in turn, initiates a primary explosive, e.g., lead azide, which, in turn, initiates a secondary explosive, such as pentaerythritol tetranitrate (PETN), at an output end of the detonator. Thus, conventional hot wire igniters cannot directly function a high density secondary explosive and must rely on an extremely sensitive primary explosive to transition the detonation process from the fuse head to a corresponding explosive output pellet.

An exploding bridgewire detonator (EBW) can serve as an alternative to the hot wire initiator. The EWB includes a short length of small diameter wire that functions as a bridge. In use, explosive material beginning at a contact interface with the bridgewire transitions from a low density secondary explosive to a high density secondary explosive at the output end of the detonator. The secondary explosive is normally PETN or cyclotrimethylene trinitramine (RDX). Like conventional hot wire initiators, an EBW cannot directly initiate a high density secondary explosive. To initiate a detonation event, a higher voltage pulse, e.g., typically, a threshold of about 500 V is applied in an extremely short duration across the bridgewire causing the small diameter wire to function the explosive material.

BRIEF SUMMARY

According to aspects of the present invention, an exploding foil initiator system comprises a substrate, an exploding foil initiator and surface-mount pads. More particularly, the substrate has a first side and a second side. The exploding foil initiator is formed on the first side of the substrate, and comprises a first contact, a second contact and a channel that electrically connects the first contact and the second contact. A first via extends through the substrate so as to align with the first contact. Analogously, a second via extends through the substrate so as to align with the second contact. A first surface-mount pad is provided on the second side of the substrate that electrically connects to the first contact of the exploding foil initiator through the first via. Likewise, a second surface-mount pad is provided on the second side of the substrate that electrically connects to the second contact of the exploding foil initiator through the second via. In this manner, a detonator system can route current through the exploding foil initiator through the vias and surface-mount pads. For instance, according to certain aspects of the present invention, a fireset is mounted to the exploding foil initiator system by electrically connecting a source of power to the first and second surface-mount pads of the exploding foil initiator. The fireset passes current through the exploding foil initiator during an initiating event.

According to further aspects of the present invention, a method of forming an exploding foil initiator is provided. The method comprises providing a substrate having a first side and a second side, forming a first via through the substrate and forming a second via through the substrate. The method further comprises forming a first surface-mount pad on the second side of the substrate that electrically connects to the first via and forming a second surface-mount pad on the second side of the substrate that electrically connects to the second via. The method still further comprises forming an exploding foil initiator on the first side of the substrate, the exploding foil initiator comprising a first contact, a second contact and a channel that electrically connects the first contact and the second contact. The first contact of the exploding foil initiator extends over the first via and is electrically coupled to the first surface-mount pad by the first via. The second contact of the exploding foil initiator extends over the second via and is electrically coupled to the second surface-mount pad by the second via.

According to yet a further aspect of the present invention, a detonator comprises an exploding foil initiator system and a fireset. The exploding foil initiator system includes a substrate having a first side and a second side, an exploding foil initiator formed on the first side of the substrate and first and second surface-mount pads formed on the second side of the substrate. The exploding foil initiator formed on the first side of the substrate comprises a first contact, a second contact and a channel that electrically connects the first contact and the second contact. A first via formed through the substrate electrically couples the first contact to the first surface-mount pad. Likewise, a second via formed through the substrate electrically couples the second contact to the second surface-mount pad. The fireset is coupled to the exploding foil initiator system such that a first electrical connection of the fireset is surface-mounted to the first surface-mount pad of the exploding foil initiator system and a second electrical connection of the fireset is surface-mounted to the second surface-mount pad of the exploding foil initiator system to pass current through the exploding foil initiator during an initiation event.

BRIEF DESCRIPTION OF THE SEVERAL VIEWS OF THE DRAWINGS

The following detailed description of various aspects of the present invention can be best understood when read in conjunction with the following drawings, where like structure is indicated with like reference numerals, and in which.

DETAILED DESCRIPTION

Figure 1:
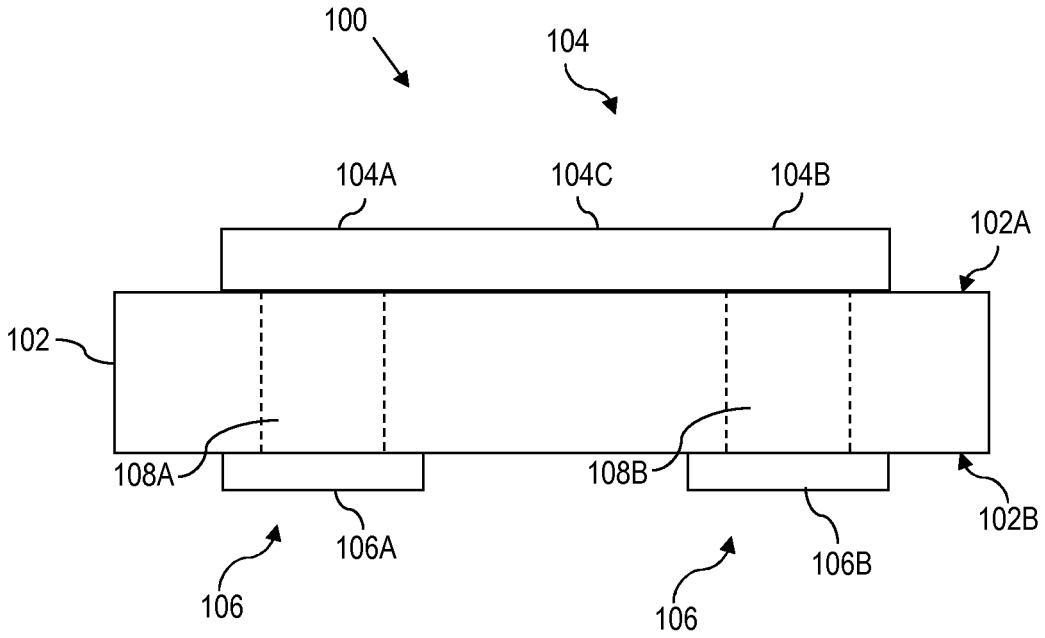
FIG. 1 is a side view of an exploding foil initiator according to aspects of the present invention.

Referring now to the drawings, and in particular, to FIG. 1, an exploding foil initiator system 100 is illustrated according to certain aspects of the present invention. The exploding foil initiator system 100 includes a substrate 102, an exploding foil initiator 104 and a connection circuit 106.

More particularly, the substrate 102 includes a first side 102A and a second side 102B. The exploding foil initiator (EFI) 104 is formed on the first side 102A of the substrate 102 and comprises a first contact 104A, a second contact 104B and a channel 104C that electrically connects the first contact 104A and the second contact 104B.

The connection circuit 106 comprises a first surface-mount pad 106A that is provided on the second side 102B of the substrate 102 generally below the first contact 104A of the exploding foil initiator 104. Likewise, a second surface-mount pad 106B is provided on the second side 102B of the substrate 102 generally below the second contact 104B of the exploding foil initiator 104.

A first via 108A is formed through the substrate 102 and extends into the first contact 104A of the exploding foil initiator 104 and the first surface-mount pad 106A. Likewise, a second via 108B is formed through the substrate 102 and extends into the second contact 104B of the exploding foil initiator 104 and the second contract 104B. As such, in the illustrated example, the first via 108A extends through the substrate 102 between (and aligned with) the first contact 104A and the first surface-mount pad 106A. Analogously, the second via 108B extends through the substrate 102 between (and aligned with) the second contact 104B and the second surface-mount pad 106B.

Thus, the first surface-mount pad 106A on the second side 102B of the substrate 102 electrically connects to the first contact 104A of the exploding foil initiator 104 through the first via 108A. Likewise, the second surface-mount pad 106B on the second side 102B of the substrate 102 electrically connects to the second contact 104B of the exploding foil initiator 104 through the second via 108B.

In this manner, a detonator system can route current through the first surface-mount pad 106A, through the first via 108A to the first contact 104A of the exploding foil initiator. The current is further routed from the first contact 104A, through the channel 104C to the second contact 104B of the exploding foil initiator 104. The current is finally routed from the second contact 104B of the exploding foil initiator through the second via 108B to the second surface-mount pad 106B.

The substrate 102 may comprise any suitable material. However, in an illustrative implementation, the substrate 102 comprises a wafer, such as silicon or alumina. The exploding foil initiator 104 may be manufactured utilizing a Metallic Vacuum Vapor Deposition (MVVD) process to deposit a conductive foil pattern defining the first and second contacts 104A, 104B and the channel 104C. Likewise, the first surface-mount pad 106A and the second surface-mount pad 106B may be manufactured using a Metallic Vacuum Vapor Deposition (MVVD) process.

As used herein, the term "via" refers to a through hole in the substrate 102 that is used to provide electrical connection between a conductive element on one side of the substrate 102 (e.g., the first contact 104A) to a conductive element (e.g., the first surface mount pad 106A) on the other side of the substrate 102. Each via may be plated, filled with a conductive material, or a combination thereof. In an illustrative implementation, the conductive material is gold or other suitable conductive material that completely fills the hole.

In other words, the conductive material of the vias is within the substrate (i.e., the conductive material of the vias are not pins, wires, or other structures that are part of the exploding foil initiator, which are pushed or otherwise inserted through or into the substrate 102).

Figure 2:
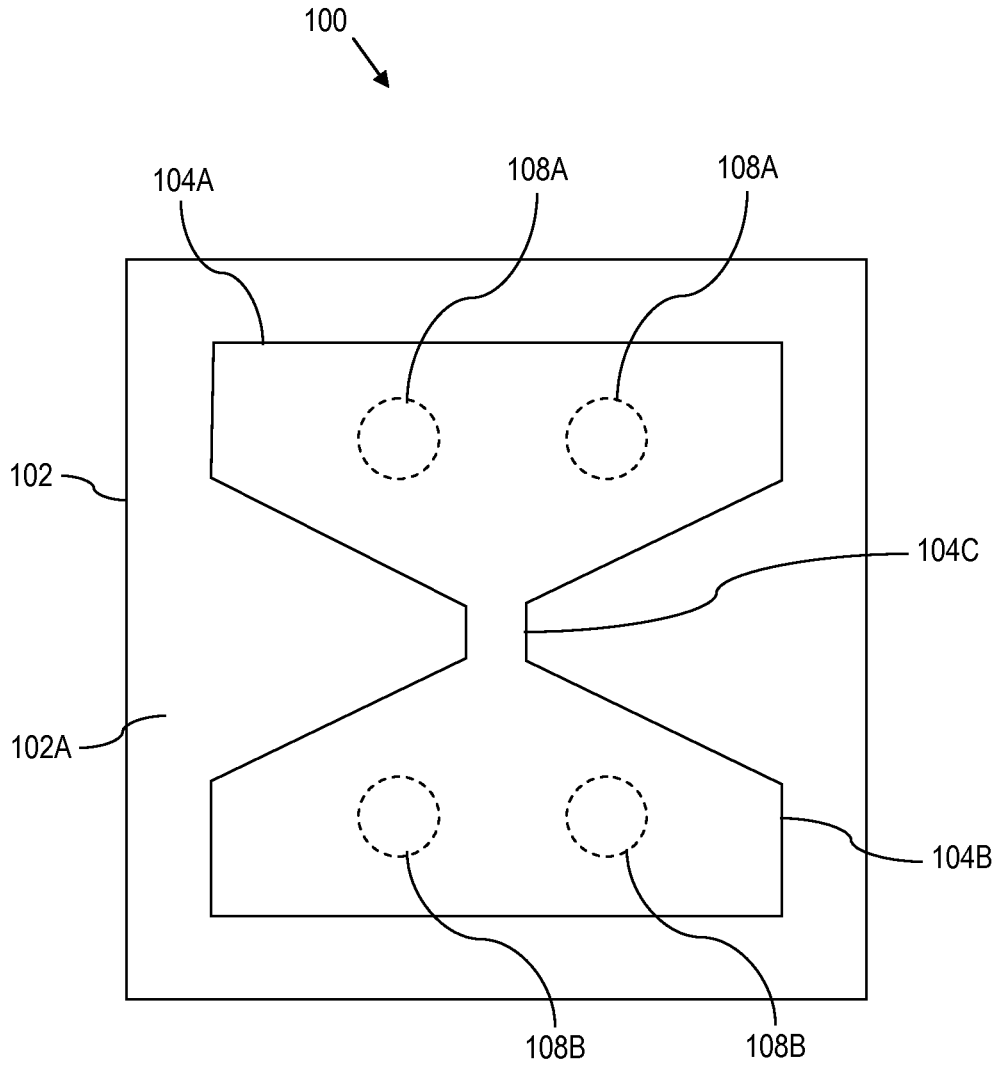
FIG. 2 is a top view of the exploding foil initiator of claim 1, according to aspects of the present invention.

Referring to FIG. 2, a top view of the exploding foil initiator system 100 of FIG. 1 is illustrated according to various aspects of the present invention. The exploding foil initiator 104 is formed on the first surface 102A of the substrate 102 as noted above. Particularly, in the illustrative implementation, the first contact 104A of the exploding foil initiator 104 is spaced from the second contact 104B of the exploding foil initiator 104 so as to "neck down" into the channel 104C such that the channel 104C forms a relatively small and narrow region of conductive material that electrically connects the first contact 104A to the second contact 104B.

For instance, the width of the channel 104C may be on the order of 5% of the width of the first and second contacts 104A, 104B. As an illustrative example, the channel 104C is approximately 0.212 microns in length between the first contact 104A and the second contact 104B, having a channel width of approximately 0.212 microns. In this regard, the overall dimensions of an example exploding foil initiator 104 are 3.24 microns by 3.24 microns. In this example, the substrate is 3.81 microns by 3.81 microns, thus enabling thousands of exploding foil initiator systems 100 to be manufactured on a single wafer.

In practice, one or more vias 108 can be used to connect each contact 104A, 104B of the exploding foil initiator 104 to a corresponding surface mount pad 106A, 106B. For instance, as illustrated, two vias are provided for each contact 104A, 104B of the exploding foil initiator 104. Moreover, other numbers of vias 108 may be utilized. The use of multiple vias 108 per contact 104A, 104B of the exploding foil initiator 104 allows for redundancy to aid in reliability. Additionally, multiple vias 108 per contact 104A, 104B of the exploding foil initiator 104 can be utilized to improve current carrying capacity through the substrate 102 to promote proper functioning of the system.

Figure 3:
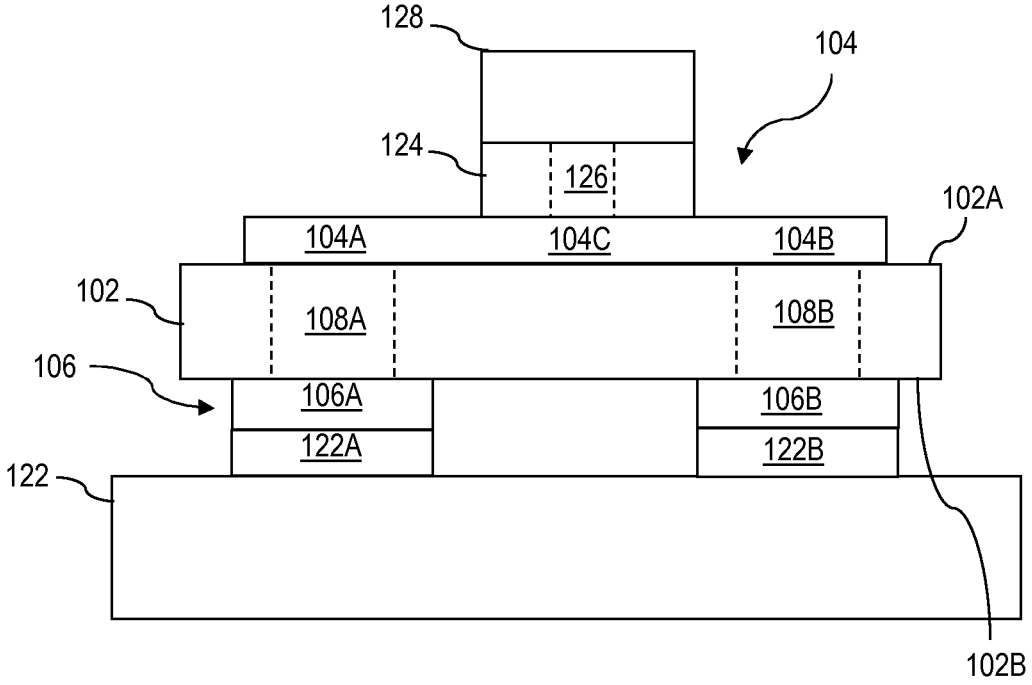
FIG. 3 is a side view of a detonator system that is mounted to the exploding foil initiator system of FIG. 1, according to certain aspects of the present invention.

Referring to FIG. 3, a detonator system is illustrated that is mounted to the exploding foil initiator system of FIG. 1, according to certain aspects of the present invention.

The detonator system includes a fireset 122. The fireset 122 electrically connects to the surface mount pads 106A, 106B of the exploding foil initiator system 100 so as to selectively provide the current necessary to function the exploding foil initiator 104 during an initiation event. More particularly, the fireset 122 includes a first conductive member 122A that is surface-mounted to the surface-mount pad 106A of the connection circuit 106. Similarly, the fireset 122 includes a second conductive member 122B that is surface-mounted to the surface-mount pad 106B of the connection circuit 106.

The fireset 122 may also contain components such as a low voltage to high voltage system and powering electronics, one or more switching capacitors, switches and other control circuitry, wired communication capabilities, wireless communication capabilities, e.g., using induction based communication or other wireless technology, an onboard controller having a microprocessor, a timer or other timing system, a global positioning system (GPS), an identification system, such as using radio frequency identification (RFID) technology and/or other systems for facilitating efficient deployment of the detonator in the field, e.g., interface with a corresponding blasting system. Other internal control and operational features may be implemented in the control electronics of the fireset 122, examples of which are described with reference to the NEBD 10A (fireset) described in U.S. Pat. No. 8,661,978, the disclosure of which is incorporated by reference herein.

Additionally, a polymer film layer is provided over the exploding foil initiator 104. As illustrated, the polymer film layer defines a barrel 124 having a barrel aperture 126 there through. The barrel 124 is positioned over the exploding foil initiator such that the barrel aperture 126 is aligned with the narrow section defining the channel 104C of the exploding foil initiator 104.

A pellet 128 of explosive material is positioned adjacent to the end of the barrel 124. The pellet 128 may comprise, by way of example, Hexanitrostilbene (HNS-IV) alone or in combination with a high brisance, insensitive secondary explosive such as Composition A5, PBXN-5, etc., that possesses considerably more shock energy than HNS-IV alone. However, in practice, other explosive materials may also be used, such as pentaerythritol tetranitrate (PETN), cyclotrimethylenetrinitramine (RDX), etc.

To initiate a detonation event, a high voltage, very short pulse of energy is applied by the fireset 122, which travels to the exploding foil initiator system 100 via the surface mount pads 106A, 106B. The current passes across the exploding foil initiator 104 to cause the channel 104C to vaporize. As the narrow section of the channel 104C vaporizes, plasma is formed as the vaporized metal cannot expand beyond the polymer film layer. The pressure created as a result of this vaporization action builds until the polymer film layer is compromised. Particularly, the pressure causes a flyer disk to release e.g., to bubble, shear off or otherwise tear free from the polymer layer. The flyer disk accelerates through the aperture 126 in the barrel 124 and impacts the pellet 128 of explosive material. The impact of the pellet 128 by the flyer imparts a shock wave that initiates the detonation of the pellet 128 and any connected explosive device.

By surface mounting the fireset to the bottom side of the substrate 102, the expense of manually wire-bonding electrical connections to top pads on the top side of the substrate is eliminated in the assembly process of coupling the exploding foil initiator 104 to control electronics, e.g., the fireset 122. Moreover, the elimination of wire-bonding on the top side of the substrate 102 leaves the top of the substrate substantially flat, improving the positioning of the next component in the assembly. For instance, the positioning of the polymer layer and corresponding barrel 124 is improved by eliminating the need for bonding wires on the top surface of the substrate 102, which are electrically coupled to the contacts 104A, 104B, because assembly can be carried out by forming layers over previously deposited (or otherwise formed) flat surfaces. This also eliminates the need for pins or printed circuit board material since wafer technology can be used with via forming techniques. Moreover, the usage of surface mount pads herein enables automated manufacturing of the final product, e.g., the automated manufacturing of the exploding foil initiator system to a corresponding fireset.

Figure 4:
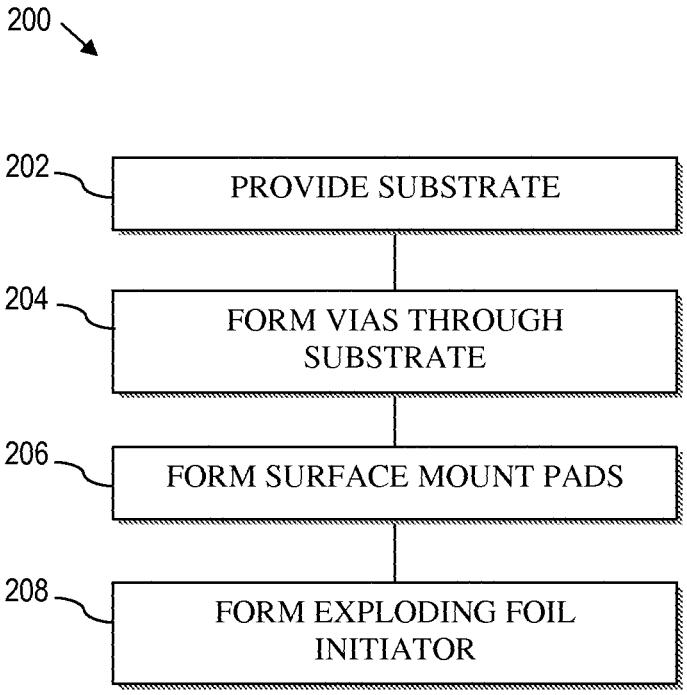
FIG. 4 is a flow chart illustrating a method of making an exploding foil initiator according to aspects of the present invention.

Referring to FIG. 4, according to further aspects of the present invention, a method of forming an exploding foil initiator is illustrated. The method 200 comprises providing a substrate having a first side and a second side at 202. The method further comprises forming vias through the substrate at 204. As an example, a first via is formed through the substrate (e.g., by drilling a first hole through the substrate) and a second via is formed through the substrate (e.g., by drilling a second hole through the substrate) to define the connections between the first side and the second side of the substrate. The vias may be plated, filled with a conductive material such as gold, or both. As noted herein, more than one via may be utilized for each contact of a corresponding exploding foil initiator. As such, in practice, multiple holes may be drilled. In a working example, multiple vias are provided for each contact. Each via is completely filled with gold or suitable conductor. As noted in greater detail herein, a "via" in this usage is a hole through the substrate which can be completely filled with metal so that a conduction path is formed in place in the substrate.

Surface-mount pads are formed at 206. For instance, a first surface-mount pad is formed on the second side of the substrate that electrically connects to the first via. Likewise, a second surface-mount pad is formed on the second side of the substrate that electrically connects to the second via. The first and second surface-mount pads can be formed by depositing an electrically conductive material on the second side of the substrate, e.g., using an MVVD process as noted in greater detail herein.

An exploding foil initiator is formed on the first side of the substrate at 208. The exploding foil initiator can be formed by depositing an electrically conductive material on the first side of the substrate, e.g., using an MVVD process as noted in greater detail herein. The exploding foil initiator comprises a first contact, a second contact and a channel that electrically connects the first contact and the second contact. The first contact of the exploding foil initiator extends over the first via and is electrically coupled to the first surface-mount pad by the first via. Likewise, the second contact of the exploding foil initiator extends over the second via and is electrically coupled to the second surface-mount pad by the second via. In this manner, surface mount pads and gold vias are utilized to provide power to the exploding foil initiator.

In an illustrative implementation, the first and second holes are drilled, and the holes are filled with a conductive material. Then, the first and second pads are formed on the second side of the substrate. Here, the first pad aligns over and electrically connects to the first via and the second pad aligns over and electrically connects to the second via. Next, the exploding foil initiator is formed on the first side of the substrate such that the first contact of the exploding foil initiator aligns over and electrically connects to the first via and the second contact of the exploding foil initiator aligns over and electrically connects to the second via.

In this manner, the surface mount pads on the back side of the exploding foil initiator substrate and filled vias through the substrate are used to route current to the exploding foil initiator.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

Having thus described the invention of the present application in detail and by reference to embodiments thereof, it will be apparent that modifications and variations are possible without departing from the scope of the invention defined in the appended claims.

What is claimed is:

1. An exploding foil initiator system comprising: a substrate having a first side and a second side; an exploding foil initiator formed on the first side of the substrate, the exploding foil initiator comprising a first contact, a second contact and a channel that electrically connects the first contact and the second contact; a first via defining a first axis through the substrate, wherein the first via forms an intersection with the first contact and aligns with the first contact; a second via defining a second axis through the substrate, wherein the second via forms an intersection with the second contact and aligns with the second contact; a first surface-mount pad on the second side of the substrate that electrically connects to the first contact of the exploding foil initiator through the first via; and a second surface-mount pad on the second side of the substrate that electrically connects to the second contact of the exploding foil initiator through the second via.

2. The exploding foil initiator according to claim 1, wherein the substrate comprises a wafer.

3. The exploding foil initiator according to claim 2, wherein the wafer comprises silicon.

4. The exploding foil initiator according to claim 2, wherein the wafer comprises alumina.

5. The exploding foil initiator according to claim 1, wherein said first via and said second via comprise gold.

6. The exploding foil initiator according to claim 1 further comprising:

at least one additional via that extends through the substrate so as to electrically connect the first contact of the exploding foil initiator to the first surface mount pad; and at least one additional via that extends through the substrate so as to electrically connect the second contact of the exploding foil initiator to the second surface mount pad.

7. A method of forming an exploding foil initiator comprising:

providing a substrate having a first side and a second side;

forming a first via through the substrate;

forming a second via through the substrate;

forming a first surface-mount pad on the second side of the substrate that electrically connects to the first via;

forming a second surface-mount pad on the second side of the substrate that electrically connects to the second via; and forming an exploding foil initiator on the first side of the substrate, the exploding foil initiator comprising a first contact, a second contact and a channel that electrically connects the first contact and the second contact;

wherein:

the first contact of the exploding foil initiator extends over the first via and is electrically coupled to the first surface-mount pad by the first via; and the second contact of the exploding foil initiator extends over the second via and is electrically coupled to the second surface-mount pad by the second via.

8. The method of claim 7, wherein:

forming the first via comprises drilling a first hole through the substrate; and forming the second via comprises drilling a second hole through the substrate.

9. The method of claim 8, further comprising filling the vias with gold.

10. The method of claim 8, wherein:

the first and second holes are drilled, and then the holes are filled and the first and second pads are formed on the second side of the substrate before forming the exploding foil initiator on the first side of the substrate.

11. The method of claim 7, wherein forming the first surface-mount pad comprises depositing an electrically conductive material on the second side of the substrate.

12. The method of claim 7 further comprising:

forming a third via through the substrate; and forming a fourth via through the substrate;

wherein:

forming a first surface-mount pad on the second side of the substrate further comprises forming the first surface-mount pad to electrically connect to the third via; and forming a second surface-mount pad on the second side of the substrate further comprises forming the second surface-mount pad to electrically connect to the fourth via.

13. A detonator comprising:

an exploding foil initiator system having:

a substrate having a first side and a second side;

an exploding foil initiator formed on the first side of the substrate, the exploding foil initiator comprising a first contact, a second contact and a channel that electrically connects the first contact and the second contact;

a first via through the substrate that extends into the first contact;

a second via through the substrate that extends into the second contact;

a first surface-mount pad on the second side of the substrate that electrically connects to the first contact through the first via; and a second surface-mount pad on the second side of the substrate that electrically connects to the second contact through the second via; and a fireset that is surface-mounted to the first and second pads of the exploding foil initiator to pass current through the exploding foil initiator system.

14. The detonator according to claim 13, wherein the substrate comprises a wafer of a select one of silicon and alumina.

15. The detonator according to claim 13, wherein said first via and said second via comprise gold.

16. The detonator according to claim 13, further comprising:

at least one additional via that extends through the substrate so as to electrically connect the first contact of the exploding foil initiator to the first surface mount pad; and at least one additional via that extends through the substrate so as to electrically connect the second contact of the exploding foil initiator to the second surface mount pad.

17. The detonator according to claim 13, wherein the exploding foil initiator is free of wirebonding such that a top surface of the detonator is flat.

* * * * *